United States Patent [19]

Dawes et al.

[11] Patent Number: 4,713,122

[45] Date of Patent: Dec. 15, 1987

[54] PRODUCTION OF THIN FLAT ARTICLES WITH HARDENED SURFACES

[75] Inventors: Cyril Dawes, Sutton Coldfield; Colin G. Smith, Solihull, both of England

[73] Assignee: Lucas Industries Public Limited Company, Birmingham, England

[21] Appl. No.: 840,778

[22] Filed: Mar. 18, 1986

[30] Foreign Application Priority Data

Mar. 20, 1985 [GB] United Kingdom ..... 8507230

[51] Int. Cl.[4] ..... C21D 1/74

[52] U.S. Cl. ..... 148/16.6; 148/16.5; 148/20.3; 148/131

[58] Field of Search ..... 148/16.6, 16.5, 20.3, 148/131

[56] References Cited

U.S. PATENT DOCUMENTS

| | | | |
|---|---|---|---|
| 1,535,191 | 4/1925 | Wemp | 148/12.4 |
| 2,814,580 | 11/1957 | Hoover | 148/31 |
| 3,510,367 | 5/1970 | Berger | 148/131 |
| 3,806,379 | 4/1974 | Darr | 148/131 |
| 4,496,401 | 1/1985 | Dawes et al. | 148/16.6 |

*Primary Examiner*—R. Dean

*Attorney, Agent, or Firm*—Nixon & Vanderhye

[57] ABSTRACT

Thin metal articles of pre-determined shape are given a first treatment to provide a hardened surface and a second treatment to correct distortion caused by the hardening treatment. The hardening is provided an epsilon nitride layer and the corrective treatment is a heat treatment at 150° to 600° C., which will correct the distortion without reducing the hardness of the epsilon nitride layer.

15 Claims, 4 Drawing Figures

PRODUCTION OF THIN FLAT ARTICLES WITH HARDENED SURFACES

The invention relates to the production of thin flat articles having hardened surfaces and in particular to thin flat articles the shape of which tends to be distorted during a surface hardening process.

It is known to harden an article of e.g. steel and it has been realised that if the article is thin the hardening treatment will tend to distort the shape of the thin article. To correct this it is known to apply a second treatment such as annealing or tempering, and a stack of thin hardened and distorted articles may be held under compression and then placed in a heat treatment furnace, and subjected to the heat treatment. See for example, U.S. Pat. Nos. 1,535,191, 2,814,580 and 3,510,367. Our evaluations have shown that a flattening process such as annealing or tempering will lower the hardness value of the article from 900 Vickers hardness value to 500 Vickers hardness value.

It is one object of this invention to provide a method of hardening a thin flat article so as to achieve the desired hardness and wear resistance and to correct the distortion caused by the hardening process such that the hardness value is maintained and even improved. This invention is based on the realisation that this object can be achieved by forming an epsilon iron nitride surface layer to provide the hardness, and then correcting the distortion under conditions such that the hardening surface layer is not impaired.

Viewed from one aspect, the invention provides a method of treating a plurality of thin metal articles so as to increase their hardness and wear resistance, the method comprising a first treatment to provide the articles with a hardened surface but which treatment tends to distort the shape of the articles and a second treatment to correct distortion caused by the first treatment, the second treatment comprising subjecting the surface hardened articles to a heat treatment while they are held in a stack under compression characterised in that (i) the first treatment is arranged to provide the thin articles with an epsilon nitride layer, and (ii) the heat treatment is carried out at a temperature of from about 150° C. to about 600° C. for a time sufficient to cause the distortion to be corrected without reducing the hardness of the epsilon nitride surface layer.

According to the invention, the post-nitriding step is crucial if the article is to be restored to the required flatness so that the hardened article may be put to its intended use with the benefit of the working surfaces having maintained or increased hardness. The heat treatment comprises subjecting a number of hardened articles, held together under compression in side-by-side abutting relation or with spacers in between. The treatment is carried out in a furnace at a temperature of from about 150° C. to about 600° C.; preferably the treatment temperature is about 350° C. in which case the treatment lasts for about one hour.

Although the post nitriding heat treatment is a simple step to perform, it was necessary for several evaluations to be made before we determined that it alone resulted in a restoration of the shape of the article to its original flatness without a deterioration in the hardness. We are aware that other workers have made attempts to solve this long standing problem, and failed to provide a satisfactory answer. Our own work has shown that a preventative treatment before the nitriding step is not effective, nor is treating each article individually. Pressure alone and heat alone will not achieve the desired result.

The thin flat article may be adapted for any industrial purpose, e.g. a paper shredder cutter or a rotor/stator lamination. Typically, in addition to being thin and flat, the article will be of complex shape having cut-outs etc. likely to aggravate the tendency to distortion. The thin article will typically be less than 2 mm thick. The nitriding step is adapted to provide the steel article with improved wear, seizure and fatigue strength. The nitriding may be performed in any of the ways which will lead to the formation of an epsilon iron nitride layer thereon. Preferably the treatment is a gas phase heat treatment and may include preliminary and later treatments such as quenching in an oil or oil/water emulsion or cooling in a protective atmosphere, optionally followed by degreasing, heat treatment in an oxidising atmosphere to provide an oxide-rich surface layer, the application of wax coating, surface finishing etc. Such techniques are described and claimed in our European patent application No. 82.305400.2-0077627 the U.S. equivalent of which is U.S. Pat. No. 4,496,401 all the disclosure of which is incorporated herein merely by this reference. It is preferred to form an epsilon iron nitride surface layer about 25 micrometres thick whereby a significant improvement in wear resistance takes place. It is also possible to carry out nitriding by molten salt bath treatment.

The steel of which the article is formed may be a low carbon alloy steel, low carbon non-alloy steel, microalloyed steel or the like. In the case of a microalloyed steel there should be up to 0.3% of chromium, titanium, niobium or vanadium.

The invention is illustrated by the following example and with reference to the accompanying drawings in which.

Flat plates P, about 2 mm thick and having a hole, such as paper cutter blades, were stamped to the required shape. The plates were separately suspended on cantilevered rails and then passed into a furnace so that an epsilon iron nitride surface layer was formed on each surface to a depth of about 25 micrometres by a method according to European patent application 82.305400.2. The hardness was measured and found to be 900 vickers hardness value and it was noted that each was distorted in that portions of the opposite surfaces were no longer parallel.

Figure 1:
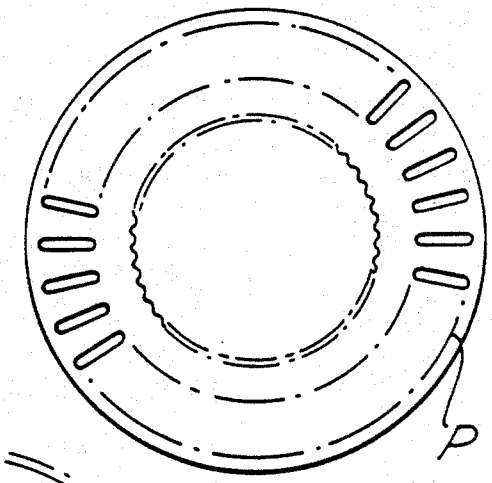
FIG. 1 shows in plan different thin plates.
Figure 2:
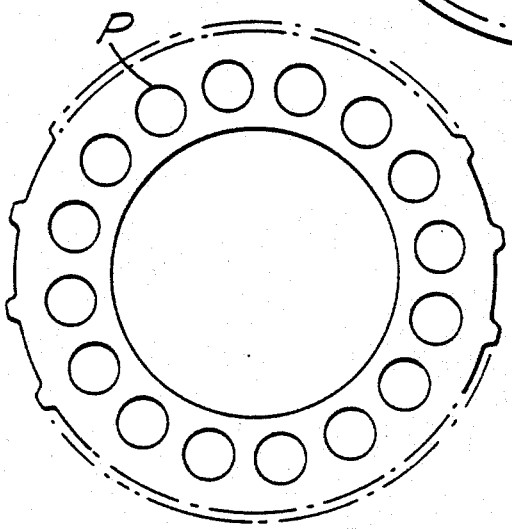
FIG. 2 shows in elevation the distortion introduced by the hardening.
Figure 2:
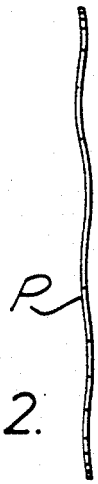
Figures 3, 4:
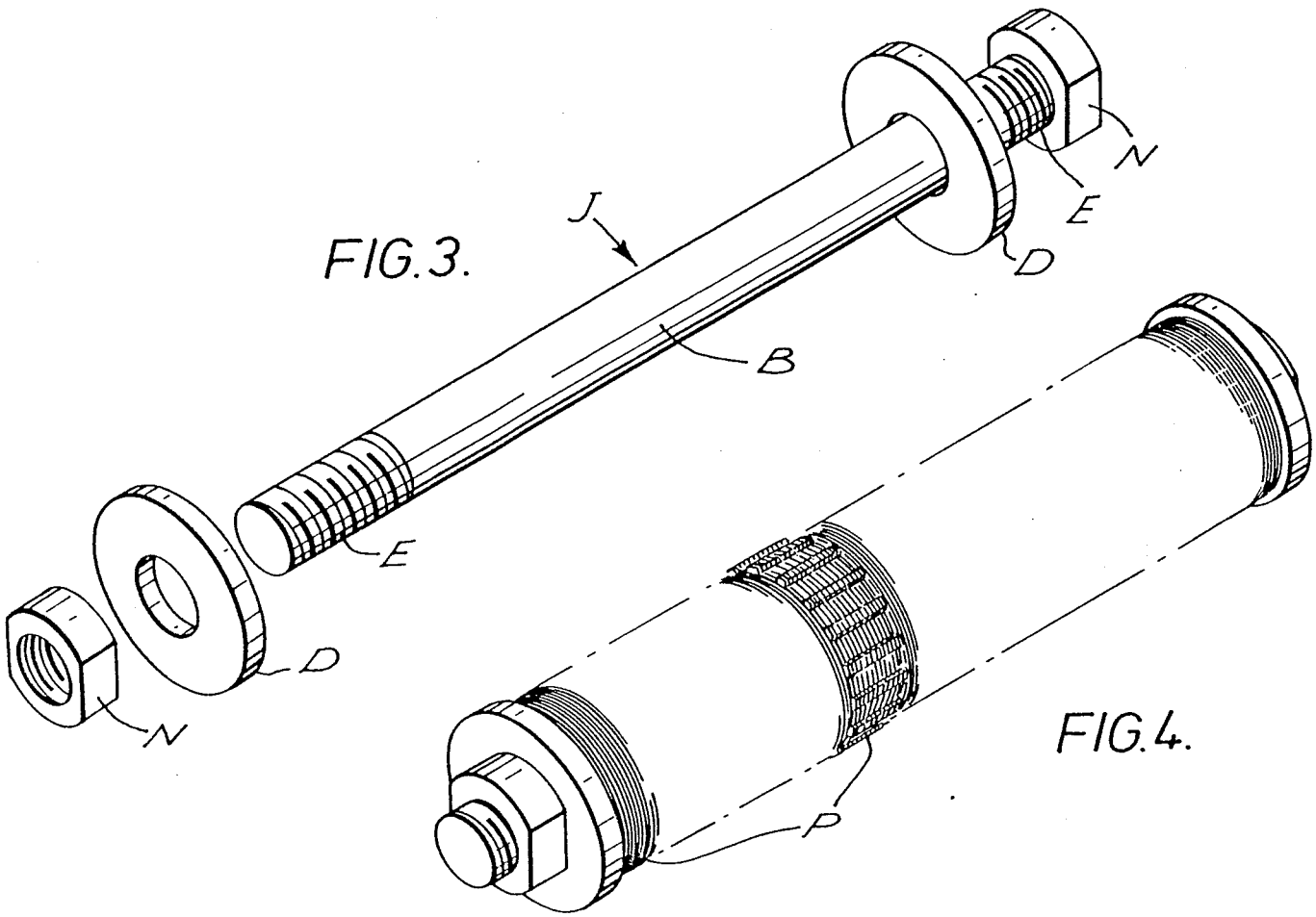
FIG. 3 shows a jig for use in the heat treatment.
FIG. 4 shows the jig with the plates to be heat treated and held under compression.

Representative thin plates P of different shapes thus treated are shown in FIG. 1. The plates are made flat but as FIG. 2 shows, the surface hardening treatment tends to distort them so that they are no longer flat. Following the surface hardening treatment, the plates P were stacked on a jig J shown in FIGS. 3 and 4 of the drawings. The jig J comprises a length of steel bolt B having a threaded portion E at each end. One disc D having a flat surface is located at one end of the bolt B, and held there by a nut N on the threaded portion. The hardened but distorted plates P, which as shown may be of different shapes, are then stacked along the length of the bolt B. When sufficient plates P are present, another clamp disc D is placed on the uppermost plate P and then a nut N threaded on to the adjacent end E of the bolt B so placing the plates P under compression when the stack appeared solid. The jig J was placed in a furnace and held there at 350° C. for about one hour. The plates were removed and each was found to have been restored to its original shape. The hardness was measured again and still was 900 HV. Each plate was then put to its intended purpose with the benefit of the improved wear resistance.

What is claimed is:

1. A method of treating a plurality of thin metal articles so as to increase their hardness and wear resistance, the method comprising subjecting the articles to a nitriding treatment to provide the articles with a hardened surface but which nitriding treatment tends to distort the shape of the articles, and then subjecting them to a heat treatment to correct distortion caused by the nitriding treatment, wherein the nitriding treatment is arranged to provide the thin articles with an epsilon nitride layer and the heat treatment comprises subjecting the surface hardened articles to a heat treatment while they are held in a stack under compression, the heat treatment being carried out at a temperature of from about 150° C. to about 600° C. for a time sufficient to cause the distortion to be corrected without reducing the hardness of the epsilon nitride surface layer.

2. A method according to claim 1, wherein said heat treatment is selected by time and temperature to increase the hardness.

3. A method according to claim 1 or 2, wherein said heat treatment is carried out for about one hour at about 350° C.

4. A method according to claim 1, wherein said thin flat article has a thickness of up to 2 mm.

5. A method according to claim 4, wherein said thin flat article has cut-outs which aggravate the tendency of the articles to distortion during said hardening treatment.

6. A method according to claim 1, wherein said thin flat article has an epsilon nitride surface layer about 25 micro metres thick.

7. A method according to claim 1, wherein said thin article is formed of a micro alloyed steel.

8. A method according to claim 7, wherein said micro alloyed steel has up to 0.3% of chromium, titanium, niobium or vanadium.

9. A method according to claim 1, wherein a stack of said thin articles to be heat treated in the heat treatment step is supported in a jig having flat end walls which is then put into a furnace for the heat treatment step.

10. A method according to claim 1, wherein said epsilon nitride surface layer is applied by gaseous heat treatment at a temperature in the range of 550–720 degrees C for up to four hours in an atmosphere consisting essentially of ammonia, ammonia and endothermic gas, ammonia and exothermic gas, or ammonia and nitrogen.

11. A method as recited in claim 10, wherein the gaseous treatment atmosphere also includes a gas selected from the group consisting of carbon dioxide, carbon monoxide, air, water vapor, methane, and mixtures thereof.

12. A method of treating a plurality of thin metal articles so as to increase their hardness and wear resistance, comprising the steps of:

subjecting the articles to a nitriding treatment to provide the articles with a hardened surface comprising an epsilon nitride layer, said nitriding treatment tending to distort the shape of the article; and correcting the distortion of the shape of the articles while simultaneously enhancing the hardness of the epsilon nitride surface layer by heat treating the articles at a temperature of from about 150 degrees C to about 600 degrees C while the articles are held in a stack under compression.

13. A method as recited in claim 12, wherein each of said thin flat articles has a maximum thickness of 2 mm.

14. A method as recited in claim 13, wherein said heat treatment step is accomplished by placing a stack of thin articles in a jig having flat end walls, and placing the jig, with retained thin articles, into a furnace.

15. A method as recited in claim 12, wherein said heat treatment step is accomplished by placing a stack of thin articles in a jig having flat end walls, and placing the jig, with retained thin articles, into a furnace.

* * * * *